US010132238B2

(12) United States Patent
Sun et al.

(10) Patent No.: US 10,132,238 B2
(45) Date of Patent: Nov. 20, 2018

(54) METHODS AND SYSTEMS FOR FREE PISTON ENGINE CONTROL

(71) Applicant: Regents of the University of Minnesota, St. Paul, MN (US)

(72) Inventors: Zongxuan Sun, Plymouth, MN (US); Ke Li, Minneapolis, MN (US); Ali Sadighi, Redondo Beach, CA (US)

(73) Assignee: Regents of the University of Minnesota, Minneapolis, MN (US)

( * ) Notice: Subject to any disclaimer, the term of this patent is extended or adjusted under 35 U.S.C. 154(b) by 12 days.

(21) Appl. No.: 13/855,363

(22) Filed: Apr. 2, 2013

(65) Prior Publication Data

US 2013/0298874 A1 Nov. 14, 2013

Related U.S. Application Data

(60) Provisional application No. 61/619,169, filed on Apr. 2, 2012.

(51) Int. Cl.

| | |
|---|---|
| ***F02B 71/00*** | (2006.01) |
| ***F02B 71/04*** | (2006.01) |
| ***F02B 63/06*** | (2006.01) |
| ***F02D 35/02*** | (2006.01) |
| *F02D 41/14* | (2006.01) |

(52) U.S. Cl.

CPC ..... *F02B 71/00* (2013.01); *F02B 63/06* (2013.01); *F02B 71/04* (2013.01); *F02B 71/045* (2013.01); *F02D 35/02* (2013.01); *F02D 35/023* (2013.01); *F02D 35/025* (2013.01); *F02D 41/1497* (2013.01)

(58) Field of Classification Search

USPC ..... 123/53.3, 53.6, 55.7, 46 R; 417/11, 159, 417/364, 380, 269, 270, 271, 505, 34, 417/279, 313, 317, 539, 559

See application file for complete search history.

(56) References Cited

U.S. PATENT DOCUMENTS

| | | | | |
|---|---|---|---|---|
| 6,286,482 | B1 * | 9/2001 | Flynn | F02B 1/12 123/25 C |
| 6,983,724 | B2 * | 1/2006 | Carlson | 123/46 R |
| 2005/0028520 | A1 * | 2/2005 | Chertok | F02G 1/043 60/517 |
| 2005/0082994 | A1 * | 4/2005 | Qiu | F16F 7/1011 318/128 |

(Continued)

OTHER PUBLICATIONS

The control of a free-piston engine generator. Part 1: fundamental analyses—R.Mikalsen, A.P. Roskilly PDF File Name: "The control of a free-piston engine generator.pdf".*

(Continued)

*Primary Examiner* — Lindsay Low
*Assistant Examiner* — Ruben Picon-Feliciano
(74) *Attorney, Agent, or Firm* — Kagan Binder, PLLC

(57) ABSTRACT

Motion control of a hydraulic free-piston engine is achieved in order to enable advanced combustions such as low temperature combustion. To accomplish this, an active controller acts as a virtual crankshaft, which causes a piston to follow a reference trajectory using energy from a storage element. Given the periodic nature of free-piston engine motion, an advanced controller of the present invention is preferably of robust repetitive type that is capable of tracking periodic reference signals.

9 Claims, 7 Drawing Sheets

(56) References Cited

U.S. PATENT DOCUMENTS

| | | | | |
|---|---|---|---|---|
| 2011/0083643 | A1* | 4/2011 | Sturman | F01B 11/006 123/46 R |
| 2013/0025570 | A1* | 1/2013 | Sturman | 123/46 R |

OTHER PUBLICATIONS

Dynamic Modeling of SIHCCI Free-Piston Engine Generators—Chia-Jui Chiang et al. PDF File Name: "Dynamic Modeling of SIHCCI Free-Piston Engine Generators.pdf".*

Abenavoli, R.I., Naso, V., Rychter, T. and Teodorczyk. A. "First Experimental Analysis of an Internal Combustion Engine with Variable Stroke and Compression Ratio", Proceedings of the 25th Intersociety , vol. 2, p. 198-203, 1990.

Kadota, M., Ishikawa S., Yamamoto K., Kato M. and Kawajiri S. "Advanced Control System of Variable Compression Ratio Engine with Dual Piston Mechanism", SAE Int. J. Engines, vol. 2 Issue 1, 2000.

Sugiyama T., Hiyoshi R., Takemura S. and Aoyama S. "Technology for Improving Engine Performance using Variable Mechanism" SAE paper, 2007-1-1290.

Mikalsen, R. and Roskilly, A.P., "A review of free-piston engine history and applications," Applied Thermal Engineering, vol. 27, Issue 14-15, pp. 2339-2352, Oct. 2007.

Hibi, A. and Ito, T., "Fundamental test results of a hydraulic free piston internal combustion engine", Proc. Inst. Mech. Eng., 2004:218:1149-1157.

Somhorst, Joop H.E. and Achten, Peter A.J., "The combustion process in a DI Diesel hydraulic free piston engine," SAE Trans., vol. 105, 1996.

Tikkanen, S. and Vilenius, M., "Control of dual hydraulic free piston engine," International journal of vehicle autonomous systems, vol. 4, Issue 1, 2006, pp. 3-23.

Shoukry, E., Taylor, S. and Clark N., "Numerical Simulation for Parametric Study of a Two-Stroke Direct Injection Linear Engine," SAE Trans., vol. 111, 2002.

Goldsborough, S.S. and Blarigan, P.V., "A Numerical Study of a Free Piston IC Engine Operating on Homogeneous Charge Compression Ignition Combustion," SAE Trans., vol. 108, 1999.

Li, K., Sun, Z., "Modeling and control of a hydraulic free piston engine with HCCI combustion," *Proceedings of the 52nd National Conference on Fluid Power*, 2011, pp. 567-576.

Li, K., Sun, Z., "Stability Analysis of a Hydraulic Free Piston Engine with HCCI Combustion", *DSCC*, 2011.

Sadighi, A., Li, K., Sun, Z., "A Comparative Study of Permanent Magnet Linear Alternator and Hydraulic Free-piston Engines", *DSCC*, 2011.

Tomizuka, M., Tsao, T.C. and Chew, K.K., "Analysis and synthesis of discrete-time repetitive controllers," ASME Trans. J.Dyn. Syst., Meas. Control, vol. 111, pp. 353-358, Sep. 1989.

Tsao, T.C. and Tomizuka, M., "Robust adaptive and repetitive digital tracking control and application to a hydraulic servo for noncircular machining," ASME Trans. J.Dyn. Syst., Meas. Control, vol. 116, pp. 24-32, 1994.

Sun, Z. and Kuo, T., "Transient control of electro-hydraulic fully flexible engine valve actuation system," IEEE Trans. on control systems technology, vol. 18, No. 3, May 2010.

* cited by examiner (a) HIL TRACKING PERFORMAMCE
(b) NET FORCE ACTS ON THE PISTON PAIR FROM COMBUSTION CHAMBERS

VIRTUAL CRANKSHAFT CONTROLLED ENGINE MOTORING

PRESSURE TRACE OF THE ENGINE CHAMBER DURING MOTORING AT COMPRESSION RATIO = 9

METHODS AND SYSTEMS FOR FREE PISTON ENGINE CONTROL

CROSS REFERENCE TO RELATED APPLICATION

This application claims the benefit under 35 U.S.C. § 119(e) of U.S. Provisional Patent Application No. 61/619,169, filed Apr. 2, 2012 and titled "Methods and Systems for Free Piston Engine Control", which is incorporated herein by reference in its entirety.

GOVERNMENT RIGHTS

This invention was made with government support under EEC-0540834 awarded by the National Science Foundation. The Government has certain rights in the invention.

TECHNICAL FIELD

The present invention relates generally to free piston engine designs and architectures, and in particular, to control systems for a free piston engine for active and dynamic control of piston trajectory.

BACKGROUND

Motorized equipment and vehicles have been specifically designed for many different applications including for use as highway vehicles, farm vehicles and industrial vehicles, such as mobile heavy equipment, which vehicles and equipment utilize fluid power as such is generated onboard using a crankshaft-based internal combustion engine (internal combustion engine) with a rotational hydraulic pump. The main drawbacks of this configuration are its relatively low efficiency and complex design of both the internal combustion engine and the hydraulic pumping system due to the dynamic operating requirements. The flexibility and efficiency of the internal combustion engine could increase significantly if variable compression ratio control can be achieved during the engine operation. Different variable compression ratio mechanisms have been developed, such as based upon variations of piston stroke distances as mechanically constrained by its connection to a crankshaft. However, such developed technologies are subjected to complicated mechanical designs and variable connecting or linking systems. Also, developed variable compression ratio mechanisms suffer from limitations of the response time of an actuation system to cause a variation of piston stroke distance.

An alternative approach is to supply fluid power using a free-piston engine (FPE) with a linear hydraulic pump. Free piston engines offer the ultimate flexibility for variable compression ratio control by eliminating the crankshaft. Such a free piston design also enables advanced combustion techniques such as based upon lower-temperature combustion, which provides better fuel economy and less $NO_x$ emissions. Other advantages of a free piston design lies in its simpler design with fewer moving parts, resulting in a compact engine with lower maintenance costs and reduced frictional losses.

Free-piston engine driven hydraulic pumps, for example, can be designed with three different basic architectures: single piston, opposed piston, and opposed chamber arrangement. Single-piston architecture is simple and relatively easy to operate. A single free-piston engine comprises a combustion chamber, a load and a rebound device. With the load being a hydraulic cylinder, the hydraulic cylinder can comprise the load that the rebound device that causes the piston for compression of a successive combustion charge.

Opposed-piston architecture utilizes a common combustion chamber arranged operatively between a pair of single piston devices. Such a design is considered to be self-balanced, and therefore produces no vibration.

An opposed chamber arrangement utilizes a pair of pistons, each associated with its own combustion chamber, which pair of pistons are connected to one another so that one combustion chamber charge moves both pistons in a direction and the other combustion chamber returns both in the reverse direction. Such a design is considered to offer higher power density and therefore a compact design.

A single piston hydraulic free piston engine has been developed within the prior art to reportedly have power output of 17 kW, and indicated efficiencies of nearly 50%. A synchronization method for an opposed piston hydraulic free piston engine design has been proposed according to other prior art systems that combines an electronically controlled hydraulic rebound and a mechanical spring system. According to this method, engine operation is demonstrated with varying power outputs. The efficiency level is shown to be almost constant throughout the power range.

A major technical barrier for bring free piston engines to mass production is the large cycle-to-cycle variation, especially during transient operation. Specifically, the compression ratio of the free piston engine cycle is mainly dependent on the dynamic coupling of the in-cylinder gas dynamics, the load and the piston motion. For a free piston engine design, for example, with 100-mm stoke and 5-mm clearance at the top dead center, a 1% variation of the piston motion (1 mm) will result in a 20% variation in the compression ratio, which will further affect the combustion performance. This imposes a huge challenge on the robust and precise engine operation control. The current free piston engine control methodologies, which are primarily calibration-based, show a limited success and mainly apply to the single piston free piston engine. By calibration-based, it is meant that controls are set for a normal operating mode based upon desired operational conditions and at an effective efficiency. Therefore, systematic active controls and design optimization that can precisely regulate the engine operation are needed.

For conventional internal combustion engines, a crankshaft is the mechanism, which brings the engine back to normal if misfire occurs. Specifically, the crankshaft and flywheel of an engine combine to provide for motion control and energy storage for each piston. Piston motion control creates a desired level of compression. Energy storage provides for the ability to cause a next compression of the next piston.

However, for free piston engines, the combustion and the piston dynamic are heavily dependent on the conditions from last cycle. In other words, a misfire from the previous cycle would result in engine stall in the following cycle. Previous works on free piston engine designs have shown limited success mainly due to the complex dynamic interactions between the combustion and the load in real-time. The systematic stability analysis and control methodology development are not well defined in the prior art.

SUMMARY

A primary goal of the present invention if the realization of precise piston motion control. In particular, the present invention focuses on the motion control of a hydraulic free-piston engine, for example, to enable advanced combustion parameters, such as low temperature combustion, which provides better fuel economy and less NOx emission.

In accordance with one aspect of the present invention, motion control of a hydraulic free-piston engine is achieved in order to enable advanced combustions such as low temperature combustion, which provides better fuel economy and less NOx emission. To accomplish this, an active controller has been developed to act as a virtual crankshaft, which causes a piston to follow a reference trajectory using energy from a storage element. Given the periodic nature of free-piston engine motion, an advanced controller of the present invention is preferably of robust repetitive type that is capable of tracking periodic reference signals.

In accordance with another aspect of the present invention, an active controller system will not only provide a stable operation, it will also regulate the engine to run at improved and even a maximum efficiency. With a mechanical crankshaft, a piston trajectory is fixed and is independent from engine speed and load. Thus, there are limited means for optimizing the engine efficiency. However, with an active controller system of the present invention that creates a virtual crankshaft, a piston trajectory can be varied in real time by altering one of more references as provided to the piston motion controller. Optimal trajectories can thus be determined for the engine under various frequencies and loading conditions, so that the engine could always run at its maximum efficiency.

As an aspect of the present invention, a linear free piston engine is provided that comprises:

a piston movably provided within an engine cylinder for providing a combustion chamber on one side of the piston and another engine chamber on an opposite side of the piston, the piston being operatively connected with a load device; and an active control system that is operatively connected with an energy storage device for controlling piston trajectory during a firing mode of the engine, the active control system comprising an operative connection between the active control system and at least one engine chamber that is provided adjacent to the piston for controllably moving the piston within the engine cylinder, and the active control system further comprising at least one engine sensor for determining at least one of piston position, combustion chamber pressure, engine chamber pressure, combustion chamber temperature, and engine chamber temperature.

As another aspect of the present invention, a method of controlling the operation of a linear free piston engine are determined wherein the engine comprises a piston movably provided within an engine cylinder for providing a combustion chamber on one side of the piston and another engine chamber on an opposite side of the piston, the piston being operatively connected with a load device, and wherein the method comprises the steps of controlling a piston trajectory during a firing mode of the engine by way of an active control system that is operatively connected with an energy storage device, by sensing at least one of piston position, combustion chamber pressure, engine chamber pressure, combustion chamber temperature, and engine chamber temperature, and thereafter determining a piston trajectory for controlling the piston trajectory according to the determined piston trajectory by way of an operative connection between the active control system and at least one engine chamber that is provided adjacent to the piston.

DETAILED DESCRIPTION

Figure 1:
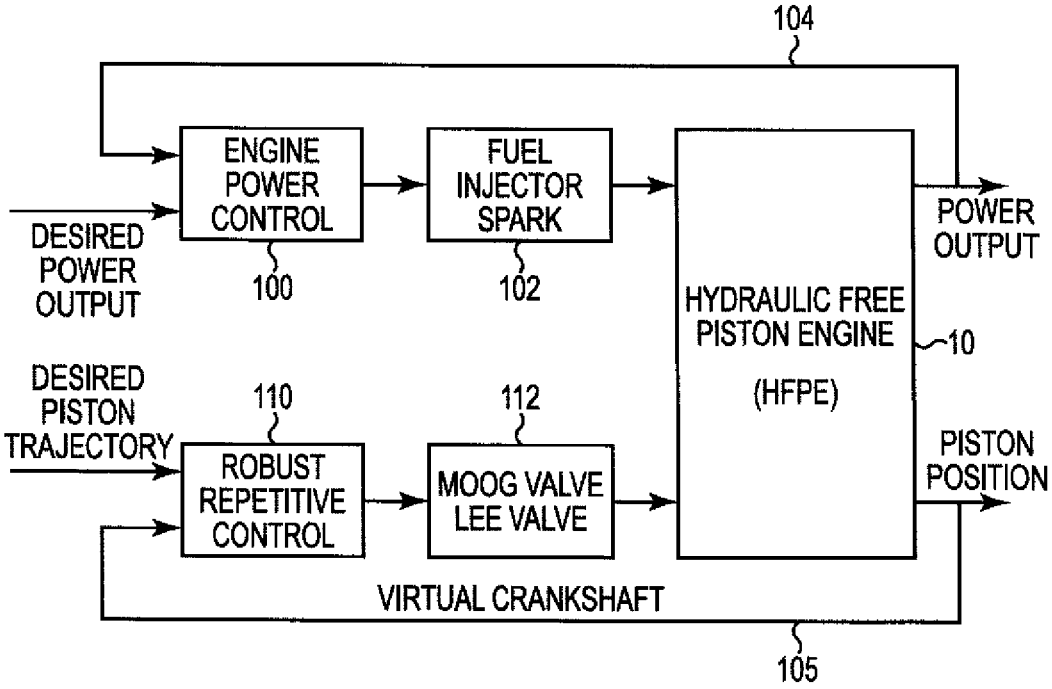
FIG. 1 is a schematic illustration of an active control architecture for controlling a hydraulic free piston engine in accordance with the present invention.

Referring now to the Figures, wherein like numerals represent similar elements throughout the several figures, and initially to FIG. 1, an active control architecture is schematically illustrated for controlling a hydraulic free piston engine 10.

Figure 2:
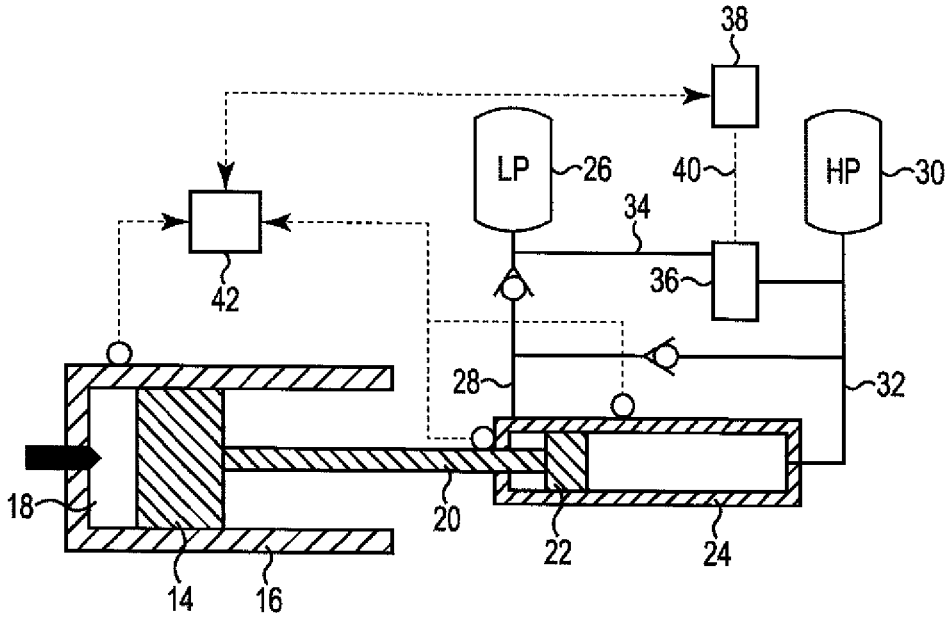
FIG. 2 is a schematic illustration of a single piston free piston engine in accordance with the present invention.

FIG. 2 schematically illustrates a single piston free piston engine comprising a piston 14 for reciprocating movement within a cylinder 16 and creating a combustion chamber 18 into which combustion gas is introduced and ignited by a spark device (not shown) such as by any conventional of developed technique. The piston 14 is connected by a rod portion 20 to a plunger 22 within a hydraulic cylinder 24. A low pressure hydraulic fluid source is shown at 26, as fluidly connected with the hydraulic cylinder 24 by lines 28, and a high pressure hydraulic fluid accumulator 30, as a high pressure source, is shown as an energy storage device (detailed below) connected with the hydraulic cylinder 24 by lines 32. Driving the piston 14 from the position shown in FIG. 2 to the right as illustrated moves the plunger 22 for pumping hydraulic fluid from the source 26 to the high pressure accumulator 30. As such, the kinetic energy of the piston 14 is converted into hydraulic energy that is stored in the accumulator 30.

With a free piston engine design, there is a so called engine motoring mode during which hydraulic energy stored within the accumulator 30 is used to cycle the piston 14 to reach a certain speed and compression ratio that is large enough for auto-ignition to occur. To accomplish this, a line 34 is illustrated for connecting the high pressure side of the illustrated system to the low pressure side of the illustrated system by way of a control valve 36.

Preferably the control valve 36 is connected to both high and low pressure sources as well as the various hydraulic chambers so that the fluid sources (either the high pressure source 30 or the low pressure source 26) can be selectively connected to one or more of the different hydraulic chambers in real-time by providing control signals to the control valve 36, or any number of such control valves as operatively arranged. This arrangement gives maximum flexibility for controlling the piston motion during both motoring and firing modes. The control valve 36 can be any conventional control valve, such as a valve known as a Moog type valve, that is preferably controlled by a solenoid (not shown) for shifting a valve body to open or close fluid flow based upon electrical signals as provided to the solenoid. With stored energy of the storage device, namely the high pressure accumulator 30, piston operational movement can be controlled by opening and closing the control valve 36 by controlled electrical signals as schematically provided from a control device 38 along the dashed signal line 40 to the control valve 36. The control device 38 can comprise any signal processing device that can receive data from remote sensors (not shown) or that is programmed for a specific control trajectory of the piston 14.

FIG. 2 also schematically illustrates a repetitive control 42, that is described is further detail below, and that is operatively connected with any number of sensors as may be provided for the purpose determining at least one of piston position, combustion chamber pressure, engine or hydraulic cylinder chamber pressure, combustion chamber temperature, and engine or hydraulic chamber temperature. The repetitive controlled can also be associated with the control device 38 or may itself comprise the control device 38.

Once the free piston engine begins operation on its own based upon combustion of gases within the combustion chamber 18, the engine is considered to be operating under the so called engine-firing mode. The engine will operate under the firing mode for so long as the sequential engine combustion strokes and compression strokes occur without interruption. The present invention is directed to the ability to control a free piston engine in both the engine motoring mode and during a firing mode to control piston trajectory, including stroke distance and its speed profile over such stroke, including when the piston is firing properly and/or after an engine misfire.

Figure 3:
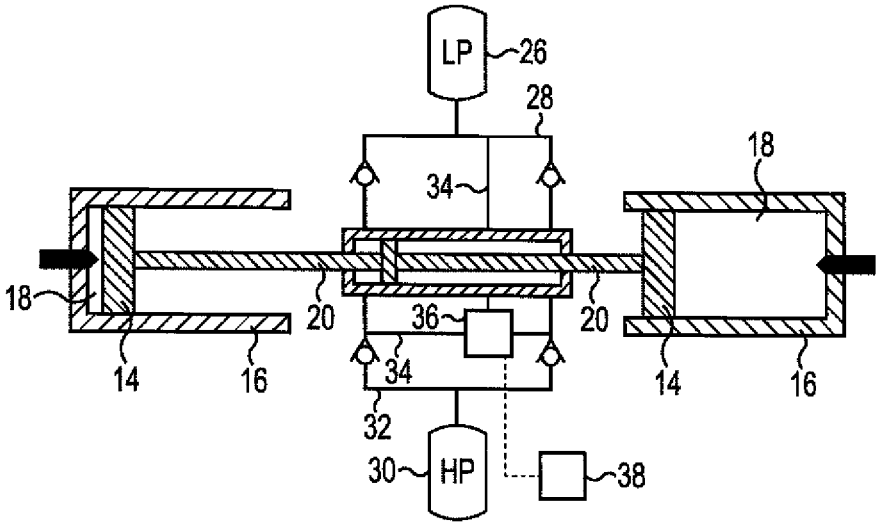
FIG. 3 is a schematic illustration of an opposed chamber architecture for a free piston engine in accordance with the present invention.

FIG. 3, schematically illustrates an opposed chamber architecture for a free piston engine that is similar to the single piston design of FIG. 2, but with two pistons 14 that are sequentially fired to drive a plunger 22 of a hydraulic cylinder 24 from both sides. Hydraulic lines 28 and 32 accommodate the provision of low pressure fluid to either side of the plunger 22 and the outflow of high pressure fluid from the respective side of plunger 22, as controlled by conventional valves (not shown). Preferably a control valve 36 is connected to both high and low pressure sources as well as the various hydraulic chambers so that the fluid sources (either the high pressure source 30 or the low pressure source 26) can be selectively connected to one or more of the different hydraulic chambers in real-time by providing control signals to the control valve 36, or any number of such control valves as operatively arranged. This arrangement gives maximum flexibility for controlling the piston motion during both motoring and firing modes.

Figure 4:
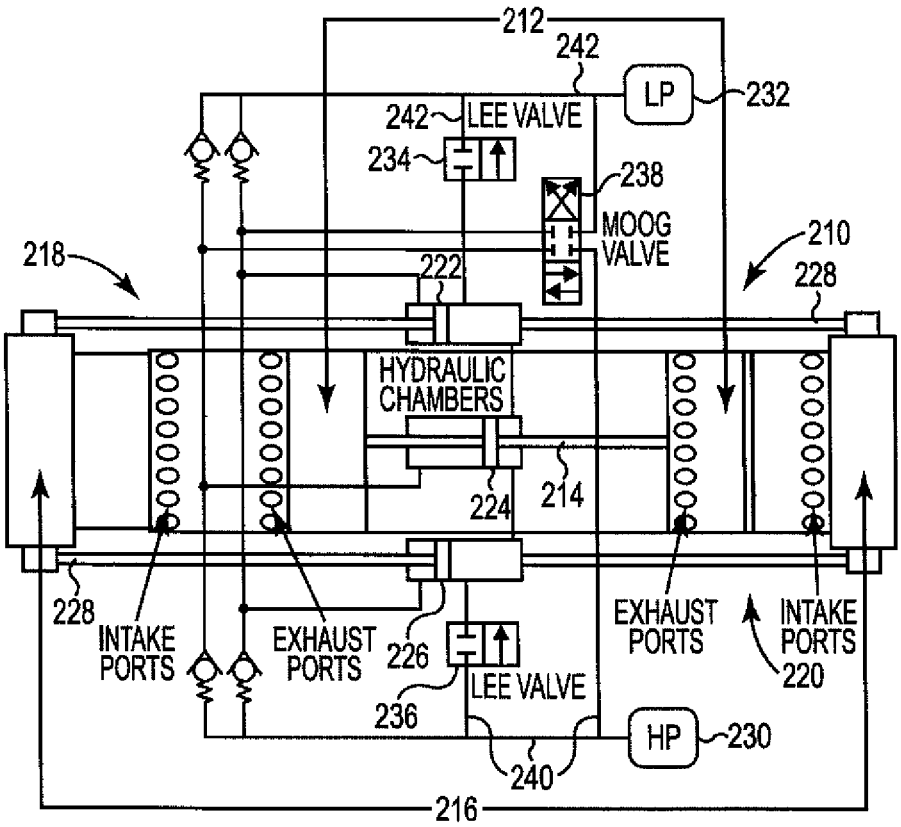
FIG. 4 is a is a schematic illustration of an opposed piston and opposed cylinder engine in accordance with the present invention.

FIG. 4 schematically illustrates an opposed piston and opposed cylinder engine, which is a more complex combination of two of the types of linear free piston engines discussed above. However, the principles of operation and control aspects including an active control system utilizing repetitive control of the present invention are included within this more complex engine design. A free piston engine 210 of this embodiment comprises an opposed-piston opposed-cylinder (OPOC), two-stroke combustion engine. As shown, a pair of inner pistons 212 are connected together by a connecting rod 214 so that they are movable together with respect to a pair of outer pistons 216. The engine can be started, for example, from a bottom dead center (BDC) position where the distance between an inner piston and an outer piston pair 218 are at the farthest from one another. Then the pistons can be caused to move relatively toward each other while (for startup under a motoring mode caused by energy within the system as discussed above) the gas in the cylinder space between the piston pair 218 is being compressed towards the top dead center (TDC) position of the inner piston 212 to the outer piston 216 of the piston pair 218, where the gas undergoes an auto-ignition process. Force generated by combustion from the auto-ignition (or a spark in a spark ignition engine) would then push the pistons of the piston pair 218 away from each other while the gas inside the other cylinder space between the other piston pair 220 is being compressed to auto-ignition. The two chambers can be fired alternatively to keep the both piston pairs 218 and 220 moving linearly.

The hydraulic block, shown in the example of FIG. 4, houses three hydraulic pumps 222, 224, and 226. Two of them (222 and 226) are located on the side push rods 228 that connect between the outer pistons 216. Preferably, a larger hydraulic pump 224 is mounted on the inner pistons 212 pair as provided operatively along with the connecting rod 214, with its plunger area preferably being equal to the total plunger area of the two smaller hydraulic pumps 222 and 226 (FIG. 4). During the piston oscillation, fluid can be pushed from the left chamber (based upon the illustration of FIG. 4) of the hydraulic pumps 222 and 226 into a high pressure source or accumulator 230, while fluid is drawn into the left chamber of the other hydraulic pump 224 from the low pressure source or accumulator 232 and vice versa. In other words, the kinetic energy of the piston is converted into hydraulic energy stored in the accumulator, which is the high pressure source 230. The right chambers of the hydraulic pumps are similarly interconnected as a synchronizing volume, and a pair of valves 234 and 236, which are preferably Lee valves, is used to control such synchronization.

A valve 238, such as a Moog-type valve discussed above, as also shown in FIG. 4, can be used to switch between the engine operations modes. That is, between the engine motoring mode during which hydraulic energy, such as that stored in the high pressure accumulator 230, can be used to cycle the pistons to reach a certain speed and compression ratio that is large enough for auto-ignition to occur and the engine firing mode during which normal engine operation occurs.

When the Moog valve 238 is at its bottom position, high pressure fluid, as hydraulically connected such as illustrated by hydraulic lines 240, is directed into the left chamber of the inner piston pump 224 and pushes the inner piston 212 to the right and compresses fluid in the right chamber which then causes the outer piston 214 to move to the left. However, when the Moog valve 238 is at its top position, the hydraulic forces would change direction and move the piston pairs in the opposite direction. The engine is switched to a pumping mode during which the fluid in the hydraulic chambers are pumped into the accumulator when the Moog valve is at its middle position. The low pressure side is also illustrated with appropriate hydraulic lines to provide fluid as needed on either side of each pump 222, 224, and 226 for pumping, such as shown at 242.

Referring back to FIG. 1, the present invention is directed to the creation of a virtual crankshaft to regulate the free piston engine operation, such as within any of the engine embodiments discussed above or any other free piston engine design. In accordance with the present invention, a real-time active piston motion controller can act as a virtual crankshaft by coordinating combustion and load as such forces are generated and applied to a piston. An active controller of the present invention can force a piston to follow a pre-determined trajectory (speed and stroke) by controlling the combustion event and the load in real time. Specifically, the combustion event initiates piston movement, and a load can be controlled to create the stroke distance and create a speed profile for the piston over the course of the entire stroke. Preferably, load control is used to control piston speed and distance profile, however, it is also contemplated that energy could be added into the system, such as from the high pressure accumulator for control aspects related to stroke distance and speed.

Given the periodic nature of free-piston engine motion, an active controller is preferably of robust repetitive type. A key feature of repetitive control is its extremely fast convergence rate of the tracking error due to its high feedback gains at desired frequency locations. It is further contemplated to modify a desired piston trajectory in real-time depending on the current operating conditions. During engine startup (motoring), a specific profile can be designed to achieve the desired compression ratio with minimum external energy. During engine combustion (firing), a specific profile can be determined to minimize the heat loss and therefore improve engine efficiency. Trajectory optimization methods of the present invention can also be used to optimize other aspects of the combustion, such as emissions.

In FIG. 1, a hydraulic free piston engine 10 is illustrated. In the upper portion of the schematic diagram, an engine power circuit is shown. In the lower portion of the schematic diagram, an active controller system is shown for creating a virtual crankshaft in accordance with the present invention. Specifically, an engine power controller 100 receives a desired power output signal, as such may be programmed or dynamically electrically provided to the power controller 100. From this, the controller 100 provides an output signal to a fuel injection and spark controller 102, as such are conventionally known in fuel injection systems for internal combustion engines, for creating and controlling a desired combustion within the engine 10, and thus a desired power output, as indicated. Preferably, a feedback circuit 104 is also provided back to the power controller 100 for comparison purposes with the desired power output value.

Regarding an active controller system of the present invention, desired piston trajectory information is preferably inputted to an active repetitive controller 110, which in turn provides any number of control signals to any number of valves, as indicated by the box 112 (such as to solenoids of certain Moog valves and/or Lee valves as are discussed herein) for controlling a desired piston trajectory within the engine 10. Sensors within the linear free piston engine 10 preferably then provide piston position information via line 105 back to the active controller 110 for comparison with inputted desired trajectory data. In accordance with the present invention, the desired trajectory information may be provided from a computational system that changes trajectory data during operation of the engine 10 for efficiency or power output needs, such as by dynamically changing compression ratios. In distinction, simple calibration of such a free piston engine would instead comprise the top portion of the schematic diagram of FIG. 1, wherein the power control circuit would be calibrated to get the desired power output without any means for dynamic control during engine firing.

Referring also to FIG. 1, in order to facilitate the above mentioned control methods in real-time, sensors (not shown) are preferably positioned throughout systems of the present invention in order to provide feedback information. Such sensors may include, but are not limited to, piston position measurement, combustion chamber pressure, hydraulic chamber pressure, combustion chamber temperature, hydraulic chamber temperature. Also, control systems and controllers of the present invention are preferably based upon computer technologies including the use of data processors that may be programmable and/or may include fixed ware. Computer control devices may be similar to those as are well known in automotive control systems in use currently for ignition control and for fuel injection control.

In a basic sense of the present invention, control of piston trajectory during engine firing is accomplished by utilizing control features as can also be applied for causing engine motoring during a start up mode. A difficulty with an active control during engine firing is the ability to control combustion and load within the time constraints of a piston's cycle. A single stroke typically occurs within about 30 milliseconds during engine firing, and it is key to control when to operate certain valves (discussed more in detail below) in order to control system pressures and thus piston trajectory. Preferably also, such active control is to be done dynamically, such as to, for example, change a compression ratio during engine operation. For each piston stroke, trajectory is a balance of forces including the combustion force on the one hand versus fluid compression forces and friction on the other.

In addition to the provision of hydraulic free piston engines, as discussed above, it is contemplated to use similar principles for controlling engine operation of an electrical free piston engine. Electrical free piston engines are also known, wherein a free piston is operatively connected with a linear alternator as a linear load device of the system. In such systems, electrical energy is generated and can be operatively connected with an energy storage device, such as a battery, which energy can be used in the motoring mode of operation of such a free piston engine design, and/or during the firing mode, in accordance with aspects of the present invention. Similarly as with a hydraulic free piston of the present invention, sensors can be provided throughout such an electric free piston engine for sensing piston position measurement, combustion chamber pressure, electrical current, combustion chamber temperature, electrical voltage, as examples. The control of load aspects of a linear alternator can be utilized in a similar manner as the control of hydraulic load aspects of a hydraulic free piston engine as described above.

The following describes certain other control aspects of the present invention. Specifically, control strategies in accordance with the present invention are described that employ robust repetitive control to achieve rapid and precise reference tracking and therefore produce an efficient and smooth engine operation. A controller acts as a virtual crankshaft which utilizes energy in a storage element to regulate piston position. It is clear that piston motion control can play a very important part in free piston engine operation, especially when conducting HCCI (homogenous charge compression ignition) with a free piston engine, for which high compression ratio is usually required. A slight change in TDC position could result in a large variation in compression ratio. Thus, to achieve the specified compression ratio, precise tracking is preferred.

To precisely track a reference signal in real-time, high bandwidth response of the system is desired. The ability to achieve high bandwidth response depends on a number of factors, which include the dynamic response of the hydraulic or electrical system, mass of the piston pair, sampling rate and the unmodeled dynamics of the system. System identification of a hydraulic system based on frequency response can be conducted. To do this, first, an open-loop hydraulic system is preferably stabilized by a proportional feedback controller. Preferably, a large control gain is chosen, as it gives faster response time and lesser steady state error. The hydraulic system will have static friction. Thus, when the system is tracking a signal with small amplitude, the steady state error could be fairly large. However, a large proportional gain helps the system overcome the friction and thus reduce tracking error. The frequency response of the hydraulic system can be obtained using the swept sine method, where a series of sinusoidal signals from 1 to 100 Hz are sent to the system and the response is recorded. The system according to this analysis is assumed to be linear as the nonlinear effect is lumped into the unmodeled dynamics. The discrete-time transfer function developed for the stabilized hydraulic system based on frequency response is:

$$\frac{B(q^{-1})}{A(q^{-1})} = \frac{2.781e^{-5}q^{-4} - 5.737e^{-4}q^{-5}}{1 - 6.247q^{-1} + 17.71q^{-2} - 29.92q^{-3}} \frac{+4.307e^{-4}q^{-6} - 9.087e^{-5}q^{-7}}{-24.51q^{-5} + 11.96q^{-6} - 3.512q^{-7} + 0.4744q^{-8}} \quad (1)$$

where $q^{-1}$ is the one step delay operator.

Despite its success in stabilizing a hydraulic system, a proportional feedback controller is incapable of tracking periodic reference signals. Accordingly, a more advance controller is preferably employed in accordance with the present invention. A controller used herein is preferably a repetitive control that is capable of tracking a periodic reference signal with a known period. A preferred feature of repetitive control is its extremely fast convergence rate of the tracking error due to its high feedback gains at the desired frequency locations.

Figure 5:
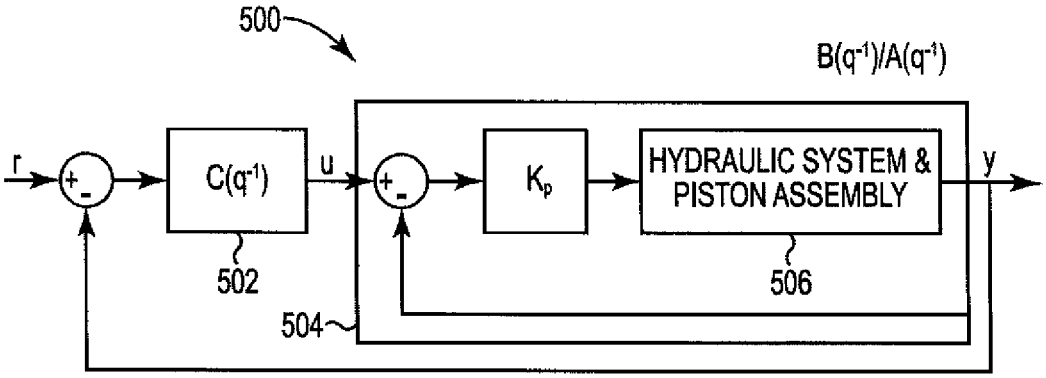
FIG. 5 is a schematic illustration of a repetitive close-loop control system in accordance with the present invention.

A repetitive close-loop control system 500 is shown in FIG. 5 comprising a repetitive controller 502 and stabilized hydraulic plant 504, which plant 504 includes a hydraulic system and piston assembly 506.

The repetitive close-loop control system is shown in FIG. 5 and can be represented as follows:

$$y(k) = \frac{B(q^{-1})}{A(q^{-1})}u(k) \quad (2)$$

$$u(k)=C(q^{-1})[r(k)-y(k)] \quad (3)$$

where k is the discrete step index, u(k) and y(k) are the input and output of the stabilized hydraulic system, r(k) is the desired motion profile and $C(q^{-1})$ is the robust repetitive controller which can be described as:

$$C(q^{-1}) = \frac{R(q^{-1})q^{-N}}{1 - q^{-N}} \quad (4)$$

The repetitive controller designed based on the idea of zero phase compensation [14-15] is used to shape $R(q^{-1})$:

$$R(q^{-1}) = \frac{K_r A(q^{-1})B^{-1}(q)}{B^{+}(q^{-1})b}, \; 0 < K_r < 2, \quad b \geq \max|B^{-}(e^{-j\omega})|^2 \quad (5)$$

where Kr is the repetitive control gain. $B(q^{-1})=B^{+}(q^{-1})B^{-}(q^{-1})$, and $B^{-}(q^{-1})$ contains all the unstable plant zeros. Large feedback gain at the repetitive signal frequency is imposed to achieve precise tracking. However, to accommodate the plant unmodeled dynamics, a compromise is needed between tracking performance and system robustness to ensure stability. A low pass filter $Q(q^{-1})$ is therefore introduced in the controller. The filter helps retain robust stability by maintaining the learning mechanism of the internal model at low frequencies while turning off the leaning at high frequencies.

Figure 7:
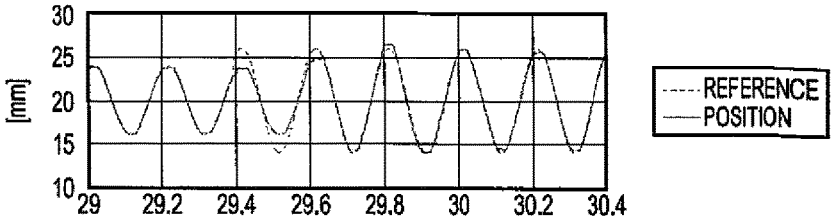
FIG. 7 is a graphical representation of a test cell in accordance with the present invention.
Figure 8:
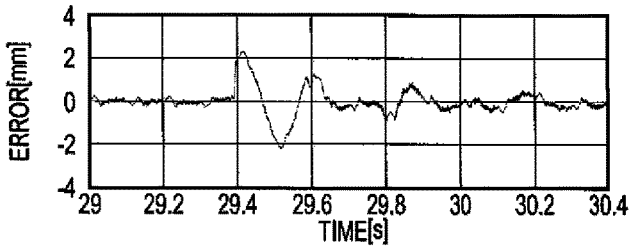
FIG. 8 is a graphical representation of transient response of a robust repetitive controller in accordance with the present invention.
Figure 9:
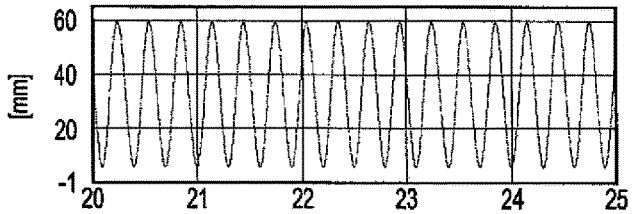
FIG. 9 is a graphical representation of a steady state tracking performance in accordance with the present invention.
Figure 10:
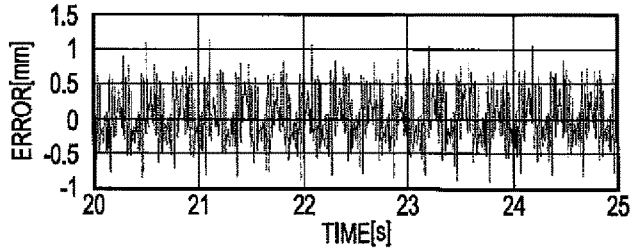
FIG. 10 is a graphical representation of steady state error related to FIG. 9 performance in accordance with the present invention.
Figure 11:
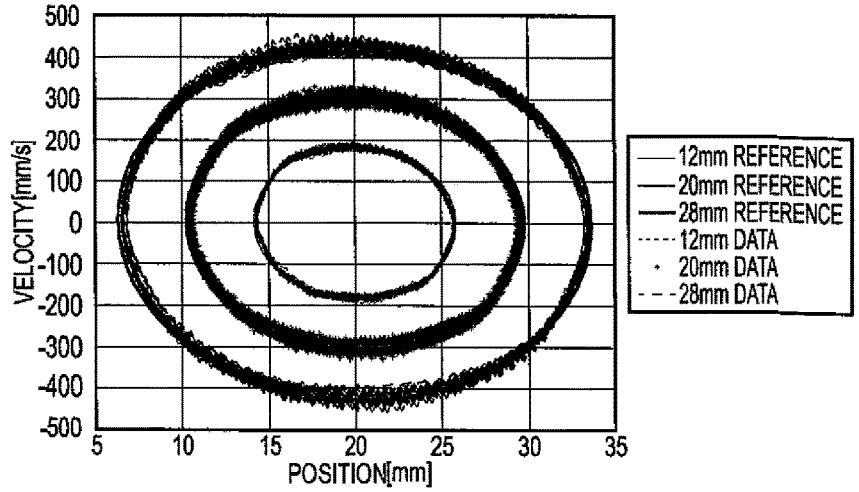
FIG. 11 is a graphical diagram of velocity vs. position under three different reference amplitudes of 12, 20 and 28 mm, shown from small to larger, respectively.

For example, a digital controller can be implemented on a dSpace system which has a 2.6 GHz processor with 16-bit analog-to-digital (A/D) and 14-bit digital-to-analog (D/A). A control system can then receive a position sensor signal and calculate the control output, which then can be amplified and sent to a Moog-type valve. An experimental set-up in a test cell is illustrated in FIG. 7. A transient response of a robust repetitive controller is shown in FIG. 8. A sudden amplitude change of the reference occurs around 29.4 s, as shown in FIG. 8, and the actual piston position is able to follow the command in the next cycle. As shown in FIG. 7, the tracking error converges to less than 0.4 mm within 3 cycles. FIG. 9 illustrates a steady state tracking performance of tracking a 3 Hz signal with 55 mm amplitude, with a steady state error within ±1 mm, as is illustrated within FIG. 10. FIG. 11 shows a velocity vs. position diagram of a system under three different reference amplitudes. This plot indicates that hydraulic subsystem actuation according to the present invention can be highly repeatable.

Figure 6:
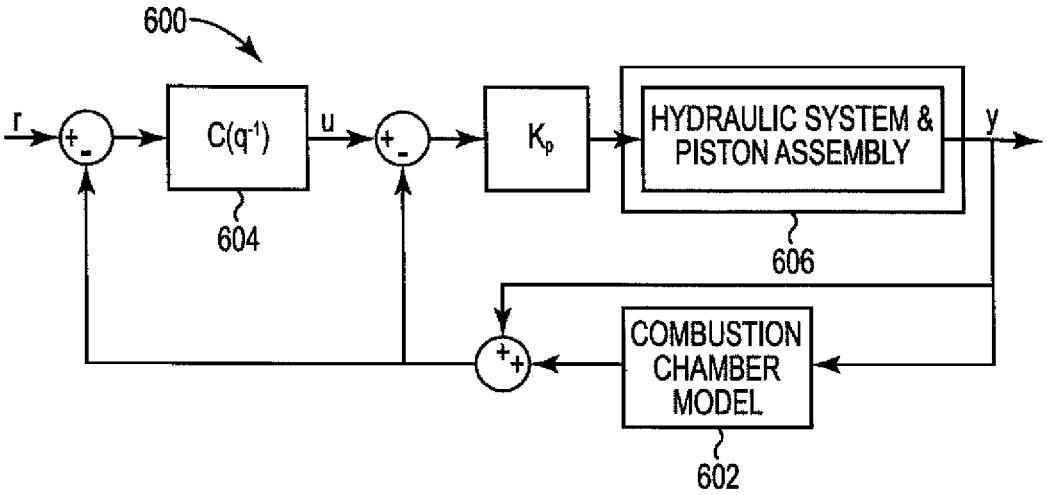
FIG. 6 is a schematic illustration of an integration of control system with combustion chamber dynamics in accordance with the present invention.

In order to demonstrate the effectiveness of a virtual crankshaft in accordance with the present invention in the presence of chamber gas dynamics, a hydraulic subsystem of the present invention was separated from an engine housing. System dynamics can be very complex once combustion chamber gas dynamics is involved. Therefore, it is desirable to have a platform that enables an investigation as to the effectiveness of a virtual crankshaft in the presence of disturbances, as could be and likely would be exerted by combustion chambers on hydraulic pistons. A hardware-in-the-loop (HIL) control system 600 was therefore designed and implemented to serve the purpose. The HIL control system 600 successfully integrates combustion chamber dynamics with a hydraulic system, which integration is illustrated within FIG. 6. In particular, FIG. 6 shows a HIL and control system configuration. The main idea is to use a combustion chamber model 602 to perturb the actual shaft position and feed this perturbed value back to a repetitive control 604 of the control system that is associated with a hydraulic system and piston assembly 606. The combustion chamber model computes the pressure difference between left and right combustion chambers based on the actual piston position from the hydraulic system.

By assuming that the combustion chamber pressure acts instantaneously on the pistons, the perturbed position can be found through the fluid volume change based on the pressure difference and fluid compressibility.

Figure 12:
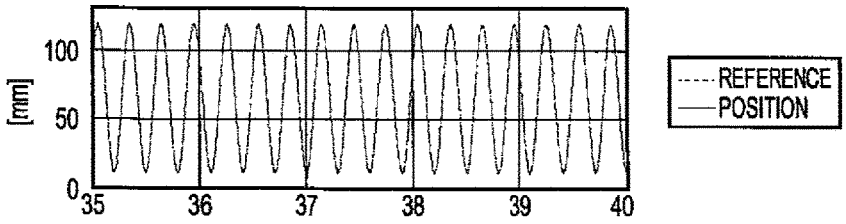
FIG. 12 is a graphical representation of tracking performance of a hardware-in-the-loop system with a repetitive controller in accordance with the present invention.
Figure 13:
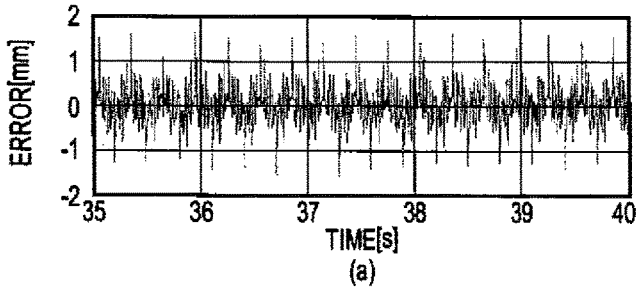
FIG. 13 is a graphical representation of error vs. time of a hardware-in-the-loop system with a repetitive controller as in FIG. 12 and in accordance with the present invention.
Figure 14:
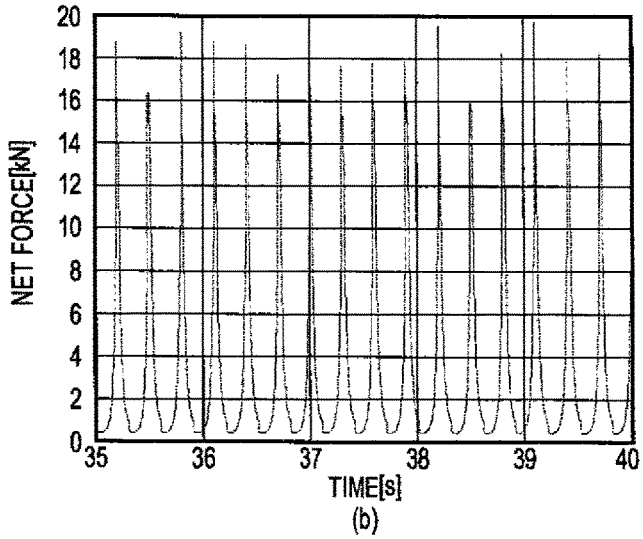
FIG. 14 is a graphical representation of net force vs. time of a hardware-in-the-loop system with a repetitive controller as in FIG. 12 and in accordance with the present invention.

FIGS. 12, 13 and 14 show the tracking performance of the HIL system with a repetitive controller. In this particular case, an expected piston travel is from 12 mm to 122 mm. In this combustion model, ignition combustion is assumed, so combustion always occurs at certain position as represented in these figures. However, to better emulate the real scenario, where the combustion may vary from cycle to cycle, a random perturbation is assigned to the temperature rise at every combustion event. FIG. 14 shows the net force from the combustion chamber that is acting on the piston during the HIL testing. And the tracking error remains very small during the HIL testing as shown in FIG. 13.

The HIL tests described above demonstrate the effectiveness of a virtual crankshaft in the presence of chamber gas dynamics. Motoring test were also conducted based upon having a hydraulic system assembled with an engine housing.

Figure 15:
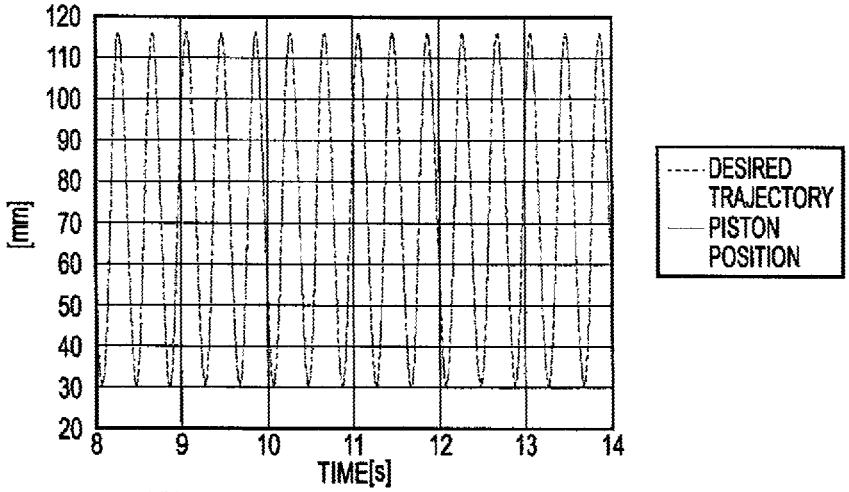
FIG. 15 is a graphical representation of performance of a controller in accordance with the present invention during engine motoring.
Figure 16:
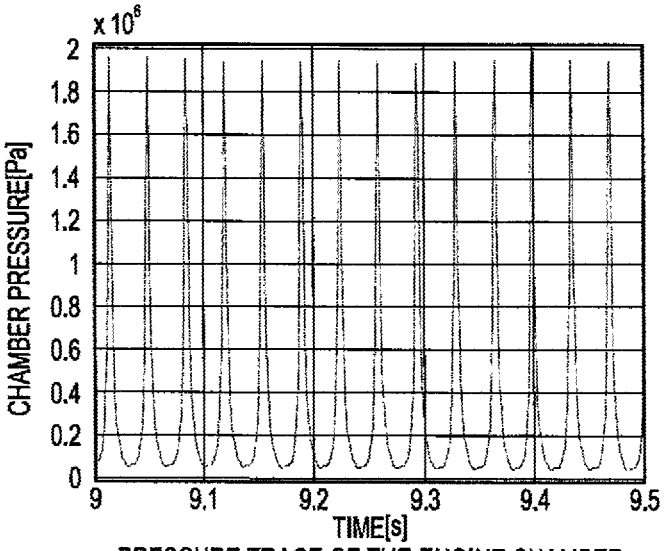
FIG. 16 is a graphical representation of chamber pressure vs. time as related to FIG. 15 and in accordance with the present invention during engine motoring.

FIG. 15 shows the performance of the controller during engine motoring. The piston is able to follow a desired trajectory with a steady state tracking error less than 1.5 mm. And by altering the reference trajectory, different compression ratios were achieved. A chamber pressure trace at a specific compression ratio is shown in FIG. 16. It is thus further contemplated to develop systematic approaches to design optimal trajectory that minimizes hydraulic energy usage during engine startup.

Despite the attractive features of free-piston engine such as variable compression ratio, compact design, less friction, etc., there has been a major technical barrier holding the technology back from being fully operational. This barrier is the precise motion control of the pistons in free piston engine. This arises from the fact that piston motion is not mechanically constrained and the dynamic couplings among the engine subsystems are sophisticated. The present invention is directed to the motion control of a hydraulic free piston engine, in particular, although other uses are contemplated. An active controller is proposed to act as a virtual crankshaft that regulates the piston to follow a predefined reference trajectory using the energy from a storage element, preferably that is usable as well for engine motoring. The virtual crankshaft enables motoring of the engine during the startup and also can be used to counteract the cycle-to-cycle combustion variations and maintain the desired position trajectory. A control-oriented linear model has been developed and used for synthesis of a robust repetitive controller. Experimental results show that precise reference tracking of the hydraulic system is made possible using the methods of the present invention. Moreover, a HIL environment that integrates the hydraulic system with a model and that captures combustion chamber dynamics, was also developed. This model allowed performance testing of a synthesized controller with the presence of chamber gas dynamics. Also, the hydraulic system has been integrated with an engine housing, and a series of engine motoring tests have also been conducted. The motoring data further demonstrates the effectiveness of the proposed method on free piston engine motion control.

The following publications are also fully incorporated within the subject specification by reference.

REFERENCES

[1] Abenavoli, R. I., Naso, V., Rychter, T. and Teodorczyk. A. "First Experimental Analysis of An Internal Combustion Engine with Variable Stroke and Compression Ratio", Proceedings of the 25th Intersociety, Vol. 2, Page 198-203, 1990

[2] Kadota, M., Ishikawa S., Yamamoto K., Kato M. and Kawajiri S. "Advanced Control System of Variable Compression Ratio Engine with Dual Piston Mechanism", SAE Int. J. Engines, Vol. 2 Issue 1, 2000

[3] Sugiyama T., Hiyoshi R., Takemura S. and Aoyama S. "Technology for Improving Engine Performance using Variable Mechanism" SAE paper, 2007-01-1290

[4] Mikalsen, R. and Roskilly, A. P., "A review of free-piston engine history and applications," Applied Thermal Engineering, Vol. 27, Issue 14-15, pp. 2339-2352, October 2007.

[5] Hibi, A. and Ito, T., "Fundamental test results of a hydraulic free piston internal combustion engine", Proc. Inst. Mech. Eng., 2004: 218:1149-1157

[6] Somhorst, Joop H. E. and Achten, Peter A. J., "The combustion process in a DI Diesel hydraulic free piston engine," SAE Trans., Vol. 105, 1996

[7] Tikkanen, S. and Vilenius, M., "Control of dual hydraulic free piston engine," International journal of vehicle autonomous systems, Vol. 4, Issue 1, 2006, pp 3-23

[8] Shoukry, E., Taylor, S. and Clark N., "Numerical Simulation for Parametric Study of a Two-Stroke Direct Injection Linear Engine," SAE Trans., Vol. 111, 2002

[9] Goldsborough, S. S. and Blarigan, P. V., "A Numerical Study of a Free Piston IC Engine Operating on Homogeneous Charge Compression Ignition Combustion," SAE Trans., Vol. 108, 1999

[10] Li, K., Sun, Z., "Modeling and control of a hydraulic free piston engine with HCCI combustion," *Proceedings of the 52nd National Conference on Fluid Power,* 2011, pp. 567-576.

[11] Li, K., Sun, Z., "Stability Analysis of a Hydraulic Free Piston Engine with HCCI Combustion", *DSCC,* 2011.

[12] Sadighi, A., Li, K., Sun, Z., "A Comparative Study Of Permanent Magnet Linear Alternator And Hydraulic Free-piston Engines", *DSCC,* 2011.

[13] Tomizuka, M., Tsao, T. C. and Chew, K. K., "Analysis and synthesis of discrete-time repetitive controllers," ASME Trans. J. Dyn. Syst., Meas. Control, vol. 111, pp. 353-358, September 1989.

[14] Tsao, T. C. and Tomizuka, M., "Robust adaptive and repetitive digital tracking control and application to a hydraulic servo for noncircular machining," ASME Trans. J. Dyn. Syst., Meas. Control, vol. 116, pp. 24-32, 1994.

[15] Sun, Z. and Kuo, T., "Transient control of electro-hydraulic fully flexible engine valve actuation system," IEEE Trans. on control systems technology, vol. 18, NO. 3, May 2010.

What is claimed is:

1. A free piston engine comprising:

a piston movably provided within an engine cylinder for providing a combustion chamber on one side of the piston and another engine chamber on an opposite side of the piston, the piston being operatively connected with a load device; and an active control system that is operatively connected with an energy storage device for controlling piston trajectory during a firing mode of the engine by coordinating cylinder combustion and piston load, the active control system comprising an active repetitive controller including desired piston trajectory information and a discretized dynamic model of the free piston engine, the active control system being represented as $$y(k) = \frac{B(q^{-1})}{A(q^{-1})}u(k) \tag{2}$$

$$u(k)=C(q^{-1})[r(k)-y(k)] \tag{3}$$

where k is a discrete step index, $q^{-1}$ is the one step delay operator, u(k) and y(k) are an input and output of a dynamic model of a free piston engine, r(k) is a desired motion profile and $C(q^{-1})$ is the active repetitive controller which can be described as:

$$C(q^{-1}) = \frac{R(q^{-1})q^{-N}}{1-q^{-N}}, \tag{4}$$

where $R(q^{-1})$ is a stable filter based on the dynamic model of the free piston engine, the active control system also comprising an operative connection between the active repetitive controller and at least one engine chamber that is provided adjacent to the piston for transmitting a control signal for controlling a desired trajectory of the piston within the engine cylinder according to a predetermined trajectory from the desired piston trajectory information based at least partially upon actual piston trajectory information and a model dependent stroke by stroke updated calculation of the control signal, and the active control system further comprising at least one engine sensor for determining at least one of piston position, combustion chamber pressure, engine chamber pressure, combustion chamber temperature, and engine chamber temperature for trajectory tracking by the repetitive controller so that that piston motion, including piston displacement, velocity, and acceleration will follow the predetermined trajectory and the desired piston trajectory information can be varied on a stroke by stroke basis of the piston relative to the engine cylinder.

2. The free piston engine of claim 1, wherein the combustion chamber is operatively connected with an engine power control that provides a desired power output signal, as such may be programmed or dynamically electrically provided to the engine power controller, to a fuel injection controller for creating a desired combustion within the combustion chamber.

3. The free piston engine of claim 1, wherein the piston is connected with a plunger of a hydraulic pump that is operatively connected with an energy storage device.

4. The free piston engine of claim 3, wherein the energy storage device comprises a high pressure fluid source connected with the hydraulic pump on one side thereof while a low pressure fluid source is connected with another side of the hydraulic pump.

5. The free piston engine of claim 3, wherein the active control system further comprises at least one controllable valve that allows high pressure fluid as stored within the high pressure source to be selectively connected to at least one hydraulic chamber of the hydraulic pump in real-time by providing control signals to the control valve.

6. The free piston engine of claim 5, wherein control signals are provided to the control valve from the repetitive control.

7. The free piston engine of claim 6, wherein the control valve can selectively connect either of the low pressure fluid source and the high pressure fluid source to either of a plurality of chambers of the hydraulic pump under the control of the active control system for defining a desired piston trajectory.

8. The free piston engine of claim 7, wherein the active control system is also functional to cause a motoring mode of the free piston engine using energy from the energy storage device selectively to cause movement to the hydraulic pump which is thus transferred to the piston of the free piston engine.

9. The free piston engine of claim 1, wherein the piston is connected with a component of a linear alternator and the energy storage device comprises a battery.

* * * * *